United States Patent [19]

Goldfarb et al.

[11] 3,961,794

[45] June 8, 1976

[54] MOTOR SKILL GAME

[76] Inventors: Adolph E. Goldfarb, 4614 Monarca Drive, Tarzana, Calif. 91356; Erwin Benkoe, 17965 Medley Drive, Encino, Calif. 91316

[22] Filed: Feb. 10, 1975

[21] Appl. No.: 548,399

[52] U.S. Cl. ..... 273/132; 273/1 R; 273/135 R; 35/22 R

[51] Int. Cl.[2] ..... A63F 9/06

[58] Field of Search ..... 35/22 A, 22 R; 273/130 R, 130 A, 130 AB, 130 B, 130 E, 131 B, 131 BA, 131 D, 132, 133, 135 R, 136 R, 136 C, 136 E, 1 R

[56] References Cited

UNITED STATES PATENTS

| | | | |
|---|---|---|---|
| 1,683,860 | 9/1928 | Cahill | 273/131 B |
| 2,219,546 | 10/1940 | Petersen | 273/131 B |
| 2,963,796 | 12/1960 | Zalkind | 35/22 A |
| 3,212,782 | 10/1965 | Jungels | 273/136 C |
| 3,488,052 | 1/1970 | Weisbecker | 273/130 R |
| 3,583,701 | 6/1971 | Glass et al. | 273/1 R |
| 3,603,591 | 9/1971 | Shoptaugh | 273/131 BA |
| 3,612,527 | 10/1971 | Rogerson | 273/1 R |
| 3,710,455 | 1/1973 | Liversidge et al. | 273/130 R |
| 3,760,511 | 9/1973 | Matsumoto | 35/22 A |

*Primary Examiner*—Anton O. Oechsle
*Assistant Examiner*—Harry G. Strappello
*Attorney, Agent, or Firm*—Robert M. Ashen; Robert J. Schaap

[57] ABSTRACT

A motor skill game which comprises a game board having a plurality of apertures therein. A plurality of pegs are provided and sized for insertion into the apertures with the number of pegs equal to the number of apertures. Each peg is provided with some form of sequenced indicia, as for example, numerical indicia, on its underside. The pegs are mixed up and randomly inserted in the various apertures. The indicia are presented downwardly and unobservable to the player until the peg is removed from its aperture. A timer is included on the game board and is started by a "start" switch. The player of the game removes one peg at a time from the apertures and returns it face down until he finds the peg with the first indicia in the sequence (e.g. number "one" or letter A); this peg he places in the first position in a peg retaining tray. He then removes pegs one at a time and replaces them face down until he finds the peg with the second indicia in the sequence; this peg he places in the second position in the tray. Thus, he will attempt to place all the pegs in the tray with their indicia in the sequential order. The player will attempt to mentally remember the positions of pegs he has removed from and replaced in apertures so that he can quickly locate them when their place in the sequence is reached. When he has placed all of the pegs in the proper sequence in the tray, he operates a "stop" switch to stop the timer. In the event that the player has not removed all of the pegs from their apertures in the time allocated by the timer, a surprise-action plate located beneath the apertures shifts to permit all of the pegs remaining in apertures to fall within the game board.

13 Claims, 5 Drawing Figures

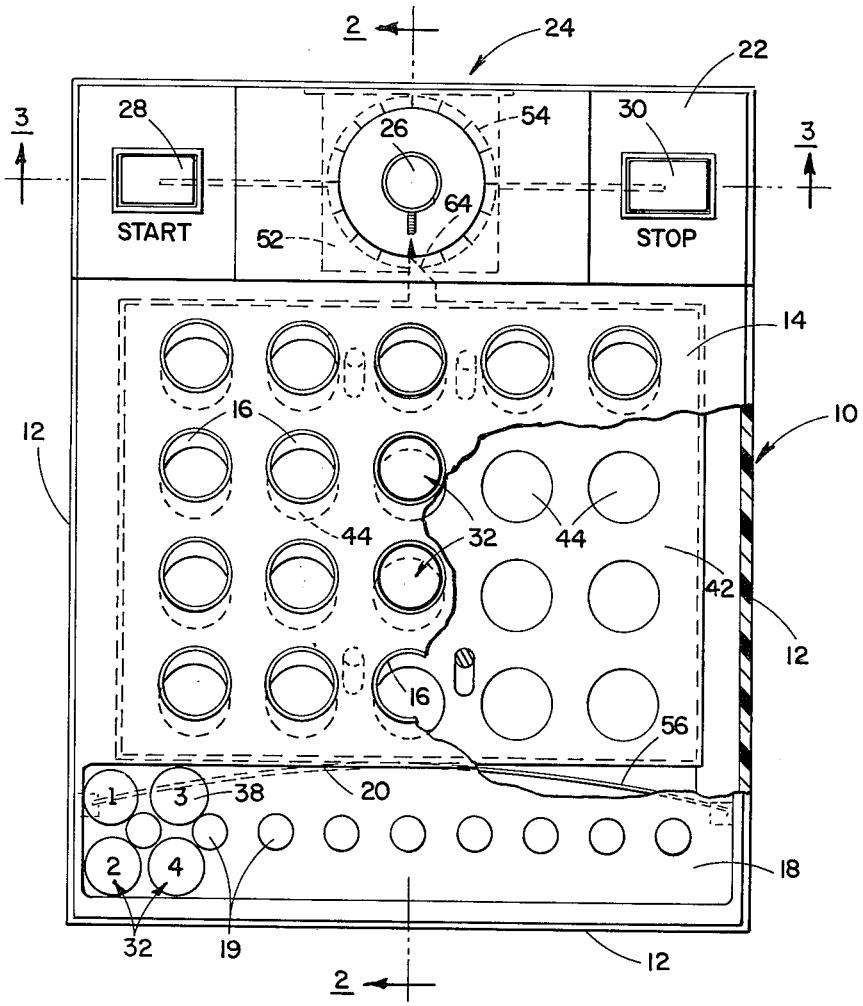
FIG. 1
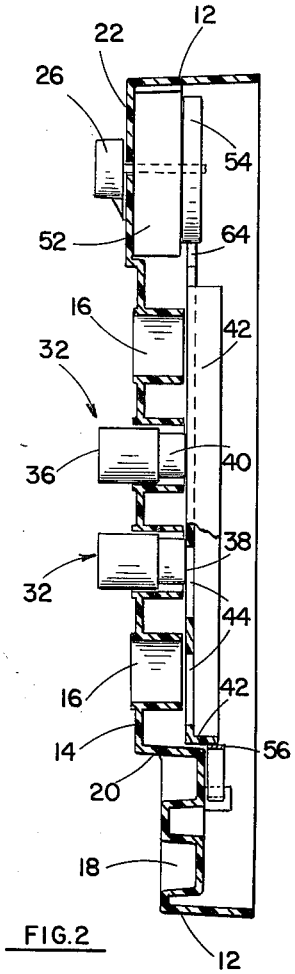
FIG. 2
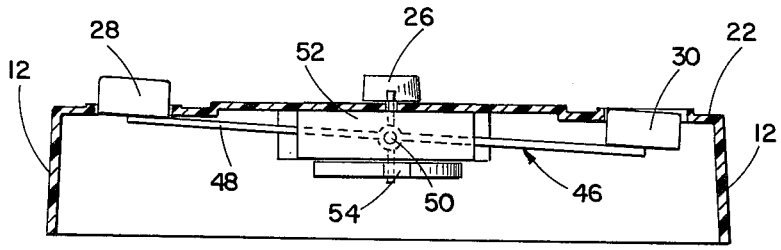
FIG. 3
FIG. 5
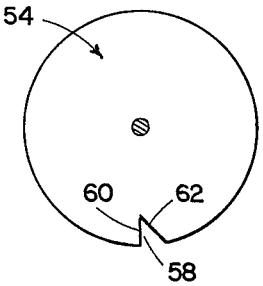
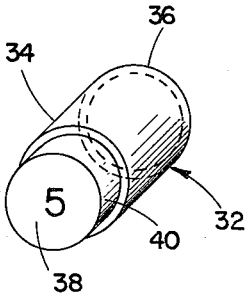
FIG. 4

MOTOR SKILL GAME

This invention relates in general to certain new and useful improvements in motor skill games, and more particularly, to motor skill games which involve memory skills and physical coordination.

There are a number of commercially available memory skill games which require the player to coordinate physical movement with memory. In each of these games, the player must mentally record a desired positional relationship of a particular element and thereafter locate several of these playing elements in a proper position in order to win the game within a pre-established time period. In the event that the player does not properly position all of these elements in the predetermined positions prior to the pre-established time interval, then the player loses the game. These games are fairly popular in that they have substantial educational value and training value in addition to the entertainment value, particularly to a preschool child.

The present invention provides a unique motor skill game which relies upon the selection of a plurality of pegs to be removed from apertures in a game board in a desired sequential order. Each of the pegs is retained in an individual aperture with indicia marked on the downwardly presented surface of the pegs so that it is not visible to the viewer. The pegs are mixed so that they are randomly located in the various apertures with respect to their indicia. The player of the game is required to select each of the pegs from the apertures in a proper sequential order in accordance with the indicia and thereafter insert the pegs in that sequential order in a retaining tray. Generally, the indicia will adopt the form of numbers, such as sequentially ordered numeric numbers. Thus, the player of the game will pick up a particular peg and note its number or indicia. The player must then select another peg if the previously selected peg is not the proper one in next sequential order. The player will continue searching the pegs until the player finds the proper next sequentially numbered peg. Thus, by mentally recording the position of the numbered pegs, the player can increase the speed in which the player can remove the pegs from the proper apertures. The game could also be played in reverse such that the player may select the pegs in the retaining tray with indicia presented downwardly and then insert the pegs in the apertures in a desired sequential arrangement.

A time is provided with the playing board of the present invention in order to allocate a predetermined time for the player to select each of the pegs from the appropriate apertures. A start switch is provided which actuates the timer and upon starting of the time, the player will start examining the various pegs and selecting these pegs from their apertures in the proper sequential order. A stop switch is provided which deactivates the timer if the player has properly removed all of the pegs from the proper apertures in their predetermined sequential order.

However, in the event that the player does not remove all of the pegs within the apertures during the pre-established time allocation and before actuating the stop switch, the timer will shift a tray which holds each of the pins in their apertures. This tray is also provided with apertures capable of being aligned with the apertures on the playing board so that the pegs will fall through the playing board in the event that the player does not win the game, that is by removing all of the pegs from the desired apertures in their sequential order within the allocated time. Thus, the game of the present invention provides the ability to teach the player motor skills as well as memory, and nevertheless provides a substantial amount of entertainment value.

It is therefore the primary object of the present invention to provide a motor skill game which involves the selection of pegs randomly located such that the pegs are selected in a proper sequential order within a pre-established time frame.

It is another object of the present invention to provide a motor skill game of the type stated which includes a timing mechanism as well as a start and stop switch located on the game board.

It is a further object of the present invention to provide a motor skill game of the type stated which provides an action surprise for ending the game play if the player has not performed the required task within an allocated time period.

It is an additional object of the present invention to provide a motor skill game of the type stated in which two or more players can play the game in order to achieve the required tasks within a minimum amount of time in order to determine the winner of the game.

It is yet another salient object of the present invention to provide a motor skill game of the type stated which can be constructed at a relatively low unit cost and which is highly effective for providing entertainment value as well as enhancing motor skills and memory skills of the players.

With the above and other objects in view, our invention resides in the novel features of form, construction, arrangement, and combination of parts presently pointed out and described in the claims.

Having thus described the invention in general terms, reference will now be made to the accompanying drawings in which:

FIG. 1 is a top plan view, partially broken away and shown in section, of a game board forming part of a motor skill game constructed in accordance with and embodying the present invention;

FIG. 2 is a vertical sectional view taken along line 2—2 of FIG. 1;

FIG. 3 is a vertical sectional view taken along line 3—3 of FIG. 1;

FIG. 4 is a perspective view of one of the pegs used with the game board of the present invention; and FIG. 5 is a top plan view of a cam used in a timing mechanism forming part of the motor skill game of the present invention.

Referring now in more detail and by reference characters to the drawing which illustrate a preferred embodiment of the present invention, A designates a motor skill game comprising an outer housing with four quadrilaterally located side walls 12 and having a game board 14 forming part of an upper surface thereof. The game board 14 is provided with a plurality of apertures 16, and, in the case of the present invention, the game board is provided with twenty apertures 16, although any number of apertures could be provided in accordance with the present invention as hereinafter described.

The game board 14 integrally merges into a recess 18 at one end of the board and which is defined by one of the side walls 12, as well as a portion of two of the adjacent and connecting side walls 12, and furthermore by a vertical interior wall 20 formed at the edge of the game board 14. The recess 18 is designed to receive a plurality of pegs, hereinafter described, and for this purpose the recess 18 may be provided with a plurality of aligned upstanding posts 19 to separate the pegs and form the rows thereof. At the opposite end of the game board, an upstanding control panel 22 is formed in the manner as illustrated in FIG. 1 of the drawings.

Operatively mounted on the control panel 22 is a manually operable timer 24 which includes a rotatable timing dial 26. The timer 24 is essentially conventional in its construction, and operates by rotating the timing dial 26 against a spring action (not shown) such that the dial 26 rotates in the direction opposite to the manual rotation thereof and the spring action provides the time interval for a complete rotation of the dial 26 from one end position to the other end position. In this respect, the dial would be operable from a start end position, where it is fully wound, to a stop end position where it is unwound. This form of timing mechanism is well known in the art and is therefore neither illustrated nor described in any further detail herein.

Also mounted on the control panel 22 is a start switch 28 and a stop switch 30. These switches 28 and 30 are manually actuable switches which are operable by mere depression of the same. The start switch 28 would initiate the operation of the timing mechanism 24 so that it moves from its initial start position (where fully wound) to its stop position (where it is completely unwound). Again, a pre-established time interval would be created by the time required for the rotatable dial 26 to move from its start position to its stop position. The stop switch 30 would operate to stop the movement of the dial prior to the end of the predetermined time period.

A plurality of pegs 32 are located within the apertures 16 and these pegs are shaped and sized to be selected from various apertures 16 on the game board 14 and placed in the retaining recess 18. Prior to insertion of the pegs 32 into the apertures 16, they are mixed up so that they are randomly located in the apertures 16 according to their indicia. In the particular illustrated and described embodiment of the present invention, the apertures 16 are circular in shape and therefore the pegs 32 are circular in shape. However, it should be understood that any size and shape aperture could be provided and, accordingly, the pegs 32 would all be provided with a similar size and shape.

Again, and with reference to FIG. 4, the particular described embodiment of the pegs 32 are tubular and have a cylindrical side wall 34 with an open ended top annulus 36 and a bottom wall 38. The lower ends of the pegs 32 which carry the bottom walls 38 are diametrally reduced and connected integrally with an annular shoulder 40. By reference to FIG. 4 of the drawings, it can be observed that this bottom wall 38 is provided with a printed indicia in the form of a numeric digit thereon. In this case, the numeric digit is that of the number 5 and which is representative of an indicia on one of the pegs 32.

For purposes of describing the present invention, it should be understood that any form of indicia to be used in sequential or otherwise ordered pattern could be imprinted on the bottom wall 38 of each of the pegs 32. In this case, the indicia are in the form of numbers, as for example numbers 1 through 20, or otherwise numbers beginning from 1 and consectively increasing through the number of pegs 32 which are provided with the game of the present invention. Again, it should be recognized that any form of indicia could be used. Thus, while the game of the present invention operates in this preferred embodiment by selecting pegs 32 from the respective apertures 16 in a sequential order, any form of ordering could be used with the present invention.

In order to play the game of the present invention, the player will actually rotate the timing dial 26 to its initial starting position. One of the players of the game will mix-up all of the pegs 32 and randomly locate the pegs 32 in the apertures 16 with the indicia thereon presented downwardly so that the indicia is not visible to the players. Thereafter, one player will actuate the start switch 28 by pushing the same which will release the timer and start the pre-established time interval. At this point, the player will then immediately select one of the pegs 32 and remove it from its aperture 16. The player must continue to search through the pegs one at a time in order to find the number 1, or otherwise the first desired indicia, for the first peg 32. When the player finds the peg with an indicia of 1 on the bottom wall 38 thereof, he will remove this peg 32 from its aperture 16 and insert the same in the tray 18. During the examination process for selecting the first peg, the player should attempt to remember the particular location of particularly numbered pegs. Thus, if while looking for peg number 1 the player has happened to pick the peg with the number 2 or 3, etc. thereon, he will reinsert the peg back into the aperture but will attempt to remember the positions of such pegs for future use. After peg 1 is found, he will look for peg 2, then peg 3, etc. As he does so, he attempts to remember for future use the location of pegs further along in the sequence. This process continues until all pegs are removed from the apertures and placed in the tray in sequence within the pre-established time interval allotted by the timing mechanism 24. If the player does this prior to the expiry of the pre-established time interval, the player will immediately actuate the stop switch 30.

It can be observed that a number of players can play the game in this way. The timer 24 may be provided with a dial having indicia thereon to indicate the amount of time during the pre-established time interval in which each player is required to find and remove the pegs in the proper order. In this respect, a desired amount of time can be set on the timer by rotating the dial. Consequently, a number of players can play against each other, with each having the desired goal of removing as many of the pegs as possible from the apertures within the time set on the timer 24. When the timer is stopped by actuating the switch 28, the player can observe the time remaining in the timer in accordance with markings on the dial.

The memory skill game of the present invention also provides a surprise action means which is designed to stop the playing of the game after a predetermined time period in the event that the player does not completely perform all functions required, e.g., remove all of the pegs from the desired apertures in their sequential order within the pre-determined time interval. The surprise action means will also affect the game in some way if the stop switch 28 has not been activated in this time interval. This surprise action means comprises a plate 42 which is located beneath the playing board 14. The plate 42 comprises a plurality of apertures 44 which have substantially the same size and shape as the apertures 16 on the game board 14.

By reference to FIGS. 1 and 2 of the drawings, it can be observed that the retaining plate 42 is located in a position such that the apertures 44 are not located in alignment with the apertures 16 on the game board. Thus, when a peg is inserted within any of the apertures 16 on the game board 14, it will bear against a portion of the retaining plate 42. However, it can be observed that when the timer 24 reaches the end of the time interval, that is the stop position, the plate 42 will shift by means of an actuating mechanism 46 to a position where the apertures 44 are in alignment with the apertures 16 in the game board 14. As this occurs, each of the pegs 32 will fall through the apertures 16 and hence through the apertures 44 into the bottom of the housing 10. In this same respect, it can be observed that the apertures 44 will always be aligned with the apertures 16 when the dial 26 of the timer 24 is located at the 0 position, or the so-called "stop" position. However, when the player of the game rotates the timing dial 26 to its start position, the plate 42 will shift the position as illustrated in FIG. 1, where the apertures 44 are not located in alignment with the apertures 16.

If the player of the game actuates the stop switch 30 prior to the expiry of the pre-established time interval, the plate 42 will remain in its position where the apertures 44 do not shift to alignment with the apertures 16 and, therefore, the pegs 32 will not fall through the apertures 44. However, the converse is also true in that if the player does not actuate the stop switch 30 prior to the expiry to the pre-established time interval, the timer dial 26 will move to the stop position and thereby cause the actuating mechanism to shift the plate 42 to a position where the apertures 44 are in alignment with the apertures 16 on the game board 14. As indicated previously, this action will permit he pegs 32 to fall through the apertures 16 and 44, thereby generating the action surprise in the event that the player does not complete the required function within the pre-established time interval.

The actuating mechanism 46 comprises a link 48 which is connected to the underside of the start switch 28 and to the underside of the stop switch 30, in the manner as illustrated in FIG. 3 of the drawings. This link 48 is connected through a pivot pin 50 which, in turn, actuates a shaft 52 on the timing mechanism 24 and which shaft 52 cooperates with the dial 26. Thus, it can be observed that after the dial 26 is rotated to its start position, and if the start switch 28 is depressed, the link 48 will shift so that the stop switch 30 is in the uppermost position. As this occurs, the link 48 will also rotate the pivot pin 50 and, through the shaft 52, actuate the timing mechanism 24 to start the timing action. This action of actuating the timing mechanism 24 is conventional and is therefore not described in any further detail herein.

It should also be observed that when the start switch 28 is shifted to its uppermost position, a cam 54 on the underside of the timing mechanism 24 will shift the plate 42 to a position where the apertures 44 are not in alignment with the apertures 16. However, when the timing dial 26 rotates and reaches the stop position, the cam 54 is at a position where it does not hold the plate 42 in a position where the apertures 44 are out of alignment with the apertures 16. Hence, in this case, a leaf spring 56 will bias the plate 42 to a position where the apertures 44 are then located in alignment with the apertures 16. In this respect, it can be observed tht any other form of spring mechanism or biasing means could be employed in place of the leaf spring 56. The leaf spring 56 may be conveniently connected to slots (not shown) in each of the end walls 12 and located to bear against one side of the plate 42.

The cam 54 is more fully illustrated in FIG. 5 and is generally circular in shape with a somewhat V-shaped notch 58 having a wall 60 somewhat parallel to a radius of the cam 54. The notch 58 is also provided with another wall 62 angularly located with respect to the wall 60. Furthermore, a flange or tang 64 on the dial 26 is selectively engageable with the notch 58 on the cam.

It can also be observed that when the stop switch 30 is depressed, the link 48 will shift to the position as illustrated in FIG. 3 of the drawings. Moreover, this action will cause the pivot pin 50 and the shaft 52 of the timing mechanism to stop rotation of the timing dial 26. In this case, the cam 54 will not be located in a position where the plate 42 is permitted to shift under the action of the spring 54 to a position where the apertures 44 and 16 are aligned.

Thus there has been illustrated and described a unique and novel motor skill game which provides a high degree of entertainment as well as the ability of the player to learn motor skills and memory skills, and which therefore fulfills all of the advantages and objects sought therfor. It should be understood that many changes, modifications, variations and other uses and applications will become apparent to those skilled in the art after their considering this specification and the accompanying drawings. Therefore, any and all such changes, modifications, variations and other uses and applications which do not depart from the nature and spirit of the invention are deemed to be covered by the invention which is limited only by the following claims.

Having thus described our invention, what we desire to claim and secure by letters patent is:

1. A motor skill game comprising:

a. a game board having a plurality of apertures therein, b. a retaining plate having a plurality of openings located beneath said game board, and being shiftable relative to said game board between a first position where the said openings align with said apertures and a second position where said openings are out of alignment with said apertures, c. a plurality of pegs sized to be inserted in said apertures and retained on said retaining plate when said plate is in the second position, and d. timing means operatively associated with said plate to shift said plate to said first position after a pre-established time interval so as to permit any of said pegs remaining in said apertures to fall down through said apertures.

2. The motor skill game of claim 1 further comprising a manually operable stop switch operatively associated with said game board to stop said timing means.

3. The motor skill game of claim 2 further including a manually operable start switch operatively associated with said timing means to start said timing means.

4. The motor skill game of claim 2 further characterized in that action-surprise means operatively exists between said retaining plate and said timing means to shift said plate and permit said pegs to fall through said apertures in the event said stop switch is not actuated to stop said timing means before termination of said predetermined time interval.

5. The motor skill game of claim 4 further characterized in that the openings in said plate are alignable with the apertures in said game board if said action surprise means in actuated to permit the pegs to fall through the apertures in said game board.

6. The motor skill game of claim 1 further characterized in that said pegs have indicia on one of their end walls to indicate a desired order for the pegs to be selected from their respective apertures.

7. The motor skill game of claim 6 further characterized in that the end walls with the indicia thereon are all located in such manner that the indicia is not readily viewable by the player when playing the game.

8. The motor skill game of claim 1 further characterized in that said pegs have indicia on one of their end walls and which indicia are sequentially numbered for each peg to indicate a desired sequential order of each of the pegs in each of the apertures.

9. The motor skill game of claim 3 further characterized in that said game board comprises part of a game frame and which game frame comprises a recessed tray to accommodate said pegs and an upstanding control panel including said start switch, said stop switch and said timing means.

10. The motor skill game of claim 4 further characterized in that said action-surprise means comprises a linkage between said plate and timing means to shift said plate in the event that the stop switch is not actuated before the end of the predetermined time interval.

11. A motor skill game comprising:

a. a game board having a plurality of apertures therein, b. a retaining means located beneath said game board, and being movable relative to said game board between a second position where said retaining means has a portion thereof disposed beneath said apertures in a peg retaining location and a first position where said retaining means has no portion thereof disposed beneath said apertures, c. a plurality of pegs sized to be inserted in said apertures and retained on said retaining means when inserted in said apertures, and when said retaining means is in the second position, d. timing means operatively associated with said retaining means to move said retaining means to said first position after a pre-established time interval, e. and stop means operatively associated with said game board to stop said timing means.

12. The motor skill game of claim 11 further comprising start means operatively associated with said timing means to start said timing means in operation.

13. A motor skill game comprising:

a. a game board having a plurality of apertures therein, b. a retaining plate having a plurality of openings located beneath said game board, and being shiftable relative to said game board between a first position where the said openings align with said apertures and a second position where said openings are out of alignment with said apertures, c. a plurality of pegs sized to be inserted in said apertures and retained on said retaining plate when said plate is in said second position, each of said pegs having one wall thereof provided with indicia to indicate a desired order of selection of the pegs and which indicia is not viewable when the pegs are located in their associated apertures, d. timing means operatively associated with said plate to shift said plate to said first position after a pre-established time interval, e. a start switch operatively connected to said timing means to initiate the operation of the timing means, f. a stop switch operatively connected to said game board to stop said timing means, g. a rotatable dial on said timing means to permit operation of said timing means, h. a cam rotatable with said dial during operation of said timing means, i. a cam follower on said plate, engageable with said cam to permit shifting movement of said plate.

* * * * *